US006338864B1

(12) United States Patent
Deering et al.

(10) Patent No.: US 6,338,864 B1
(45) Date of Patent: Jan. 15, 2002

(54) CANISTER WITH ADHERED PAPER LAYERS FOR A PARTICULATE-TYPE PRODUCT

(75) Inventors: Curtis J. Deering; Patrick J. Sumpmann, both of Maple Grove; Sarah J. Moberg, Minneapolis, all of MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/346,441

(22) Filed: Jul. 1, 1999

(51) Int. Cl.[7] ..... B65D 85/00; B65D 55/00

(52) U.S. Cl. ..... 426/106; 426/115; 426/127; 426/394; 426/398; 229/122.32; 229/4.5

(58) Field of Search ..... 426/106, 115, 426/127, 398, 394; 53/415, 449; 229/132, 136, 122.32, 4.5; 206/459.5, 831, 813

(56) References Cited

U.S. PATENT DOCUMENTS

| | | | | |
|---|---|---|---|---|
| 2,142,470 A | * | 1/1939 | Claff | 229/164.1 |
| 2,889,976 A | | 6/1959 | Van Cantfort | 229/125.11 |
| 2,971,686 A | | 2/1961 | Mühlhoff | 229/102 |
| 3,110,121 A | * | 11/1963 | Corrinet | 40/312 |
| 3,269,635 A | * | 8/1966 | Bergstein et al. | 229/117.3 |
| 3,768,719 A | * | 10/1973 | Johnson | 229/14 R |
| 3,914,483 A | * | 10/1975 | Stipek, Jr. | 428/42 |
| 3,958,744 A | | 5/1976 | Herglotz | 229/100 |
| 3,960,793 A | * | 6/1976 | Bosniack | 260/28.5 AS |
| 3,994,089 A | | 11/1976 | Schwartz | 40/310 |
| 4,171,085 A | | 10/1979 | Doty | 229/400 |
| 4,306,367 A | | 12/1981 | Otto | 40/312 |
| 4,306,934 A | * | 12/1981 | Seppanen | 162/209 |
| 4,308,679 A | | 1/1982 | Ray, III et al. | 40/312 |
| 4,311,746 A | * | 1/1982 | Chavannes | 428/110 |
| 4,324,058 A | | 4/1982 | Sherwick et al. | 40/310 |
| 4,345,393 A | | 8/1982 | Price et al. | 40/312 |
| 4,353,764 A | | 10/1982 | Sireix | 156/203 |
| 4,430,816 A | | 2/1984 | Seton et al. | 40/638 |

(List continued on next page.)

FOREIGN PATENT DOCUMENTS

| | | | | |
|---|---|---|---|---|
| WO | 90/14950 | * | 12/1990 | B32B/31/12 |
| WO | WO 99/30974 | | 6/1999 | B65D/5/56 |

OTHER PUBLICATIONS

Three–Dimensional Pioneer® Baking Mix packaging as shown in five photographs depicting different views, Copyright 1996 Pioneer Flour Mills.

Gardetto's® Snak–ens Snack Mix packaging depicting front and back side views. Copyright–Seville Flexpack Corporation.

Gardetto's® Chips & Twists Snack Mix packaging depicting front and side panel views. Copyright 1998 Gardetto's.

*Primary Examiner*—Nina Bhat
(74) *Attorney, Agent, or Firm*—John A. O'Toole; Douglas J. Taylor; Timothy A. Czaja

(57) ABSTRACT

A canister for containing a particulate-type product. The canister includes opposing face panels, opposing side panels, a top closure and a bottom closure. The opposing side panels are connected to the opposing face panels to define an upper opening and a lower opening. Further, at least one of the opposing side panels or the opposing face panels includes a first paper-based layer, a second paper-based layer and an adhesive. Each of the first and second layers has an inner surface and an outer surface. The adhesive bonds the inner surface of the first layer to the outer surface of the second layer. The top closure is connected to the opposing face panels and the opposing side panels so as to encompass the upper opening. Finally, the bottom closure is connected to the opposing face and the opposing side panels so as to encompass the lower opening. Upon final assembly, the panels combine to define an internal storage region for containing the particulate-type product.

42 Claims, 9 Drawing Sheets

U.S. PATENT DOCUMENTS

| | | | | | |
|---|---|---|---|---|---|
| 4,537,586 | A | | 8/1985 | Gale et al. | 493/220 |
| 4,673,126 | A | | 6/1987 | Hambleton | 229/43 |
| 4,724,166 | A | * | 2/1988 | DeBruin | 427/208.8 |
| 4,768,703 | A | | 9/1988 | Sosler et al. | 229/123.1 |
| 4,813,545 | A | * | 3/1989 | Chung et al. | 206/621 |
| 4,842,303 | A | | 6/1989 | Molenda | 281/38 |
| 4,880,964 | A | | 11/1989 | Donahue | 235/462 |
| 4,889,884 | A | * | 12/1989 | Dust et al. | 524/314 |
| 5,007,578 | A | | 4/1991 | Simone | 229/1.5 B |
| 5,057,359 | A | * | 10/1991 | Merdem et al. | 428/213 |
| 5,078,273 | A | | 1/1992 | Kuchenbecker | 229/207 |
| 5,098,131 | A | | 3/1992 | Tucker | 283/105 |
| 5,100,180 | A | | 3/1992 | Tucker | 283/105 |
| 5,141,254 | A | | 8/1992 | Ring | 283/105 |
| 5,172,936 | A | | 12/1992 | Sullivan et al. | 283/81 |
| 5,324,559 | A | | 6/1994 | Brombacher | 428/40 |
| 5,484,167 | A | | 1/1996 | Donaldson et al. | 283/67 |
| 5,566,529 | A | | 10/1996 | Sireix | 53/412 |
| 5,591,290 | A | * | 1/1997 | Walter et al. | 156/152 |
| 5,672,030 | A | * | 9/1997 | Dean | 412/7 |
| 5,727,819 | A | | 3/1998 | Grosskopf et al. | 283/81 |

* cited by examiner

CANISTER WITH ADHERED PAPER LAYERS FOR A PARTICULATE-TYPE PRODUCT

CROSS REFERENCE TO RELATED APPLICATIONS

This application is related to U.S. patent application Ser. No. 09/328,917, now abandoned, entitled "Canister For A Particulate-Type Product" filed on Jun. 9, 1999, assigned to the same assignee, and incorporated by reference thereto. In addition, this application is related to U.S. patent application Ser. No. 09/346,189, entitled "Double Cut Seal Membrane For A Canister Containing A Particulate-Type Product; to U.S. patent application Ser. No. 09/346,443, entitled "Perforated Air-Tight Seal Membrane For A Canister Containing A Particulate-Type Product"; and to U.S. patent application Ser. No. 09/346,440, entitled "Canister With Venting Holes For Containing A Particulate Type Product", all filed on even date herewith, assigned to the same assignee, and incorporated by reference thereto.

BACKGROUND OF THE INVENTION

The present invention relates to a canister for containing a particulate-type product. More particularly, it relates to a canister having at least two paper-based layers adhered to one another for storing a particulate-type product, such as a ready-to-eat cereal.

An extremely popular form of packaging for dry, particulate-type products sold to consumers is a paper carton. The paper carton normally is rectangular-shaped, constructed of one or more layers of paper (such as label stock or paperboard having printing on an outer surface) and may or may not include an additional plastic liner. A wide variety of different products are packaged in this form, ranging from consumable items such as cereals and baking goods, to non-consumable items such as laundry detergents and de-icing salt pellets. Paper cartons present a number of advantages for manufacturers, retailers and consumers. For example, paper cartons are relatively inexpensive to manufacture and provide a number of flat surfaces onto which product or promotional information can be displayed. Due to the rectangular, parallel-piped shape, the cartons are relatively rigid and readily stackable. Thus, the manufacturer can ship a large number of stacked cartons without experiencing product damage. Further, a retailer can maximize shelf space while fully displaying the product. Consumers likewise find the stackability characteristic desirable for home storage. Finally, paper cartons are typically sized in accordance with consumer preferences such that a desired amount or volume of product is provided with each individual carton.

Certain types of products are amenable to storage within a paper carton alone. Generally speaking, however, a paper carton cannot, in and of itself, adequately maintain product integrity. For example, a paper carton likely will not prevent aroma, moisture, contaminants, small insects, etc. from passing through to the contained product. Thus, packaging for most particulate-type products requires an additional container or liner disposed within the paper carton. This is especially true for consumable/food products. A widely accepted technique for maintaining product integrity is to place the product into an inner container or bag that in turn is stored in the carton (commonly referred to as "bag in a box"). The bag is typically made of a plastic or glassine material and is sealed about the product. In this sealed form, the bag maintains product freshness and provides protection against insect infestation, whereas the outer paper carton provides packaging strength and display. Alternatively, a double packaging machine (DPM) technique may be employed to form a plastic or glassine liner within a paper carton. Regardless of the exact manufacturing process, the resulting packaging configuration includes a box with an inner liner. The box is a single layer paperboard or label stock material that provides structural integrity, whereas the inner liner serves as a barrier material.

The box with an inner liner packaging approach is universally employed. In fact, from a manufacturer's standpoint, box with an inner liner packaging satisfies a number of important criteria including low cost, stackability, and large, flat surfaces for displaying product and promotional information. Importantly, the resulting package must also be inherently rigid to withstand forces encountered during shipping. Unfortunately, however, consumers may encounter several potential drawbacks. These possible disadvantages are perhaps best illustrated by reference to a ready-to-eat cereal product, although it should be understood that a wide variety of other products are similarly packaged.

Most ready-to-eat cereal products are sold to consumers in the box with an inner liner packaging format. To consume the cereal, the user must first open the paper carton. In this regard, a top portion of the carton typically forms at least two flaps folded on top of one another. The flaps are initially at least partially adhered to one another with an adhesive. By pulling or otherwise tearing one flap away from the other, a consumer can then access the inner bag. An all too common problem is that the selected adhesive creates too strong a bond between the flaps, making flap separation exceedingly difficult. In fact, consumers may become frustrated with the separation process and resort to partially or completely tearing both flaps away from the carton.

Once the carton has been opened, the consumer must then open the inner bag. Once again, this may be a cumbersome procedure. More particularly, an elongated seal is typically formed and extends along a top portion of the bag. This seal is broken (or "opened") by pulling apart opposite sides of the bag. In some instances, the so-formed seal is too rigid for simple opening. Even further, a person with reduced dexterity and strength, such as a child or elderly individual, may have difficulty in breaking an even relatively light seal. As a result, attempts at opening the inner bag or liner often result in an undesirable tear along a side of the bag, causing unacceptable product displacement from the bag, or an uneven opening. Additionally, the person may resort to using a knife or scissors, possibly resulting in bodily harm to the user.

Once the carton and bag or liner has been opened, the consumer is then ready to pour the contents from the package. Due to the flexible nature of the inner bag, the actual opening through which the product flows is unpredictable. That is to say, the opening formed in the bag is not uniform or fixed. As a result, a larger than expected volume of product may unexpectedly pour from the container. Alternatively, where the inner bag has not been properly opened, product flow may be unacceptably slow. Further, an inherent bias or bend typically causes the flaps to extend upwardly relative to a top of the carton. Thus, the flaps will impede a user from visually confirming acceptable product volume and flow. Additionally, the inner bag typically is not secured to the carton. During a subsequent pouring operation, then, the entire bag may undesirably release from the carton. A final concern relates to the ease with which a user can handle the carton during the pouring operation. To this end, the carton is typically configured to form an elongated, rectangular cylinder having four rigid, ninety-degree corners. This rigid construction can render grasping of the package difficult, especially for a user with limited hand dexterity, such as a child or elderly individual.

A further consumer concern relating to box with an inner liner packaging stems from attempts to reclose the package for subsequent storage of remaining product. Again with reference to widely employed ready-to-eat cereal packaging, following dispensing of a portion of the cereal from the package, the user is then required to roll or fold the top portion of the bag or liner over onto itself so as to "close" the bag. It is not uncommon for a user to simply forget to perform this operation. Alternatively, even where an attempt is made, the bag cannot be resealed and thus remains at least partially open. Similarly, the bag may subsequently unroll. Individual cereal pieces may be undesirably released from the bag and/or contaminants can enter into the bag. Regardless, the reclosure feature normally associated with the carton normally does not provide an effective barrier to unexpected product displacement and/or contamination due to removal, poor design, misuse, lack of use, etc. These concerns are exacerbated when attempting to store a previously-opened package on its side or when the package is accidentally dropped. In either case, because neither the carton nor the bag provides a complete closure, unanticipated release of cereal from the container may occur.

Viewed as a whole, concerns relating to standard box with an inner liner packaging present numerous opportunities for consumer dissatisfaction. Essentially, consumer preferences for improvements to particulate-type product packaging can be separated into four categories. Consumers prefer that the package be easy to open, easily and satisfactorily reclosed, facilitate consistent and easy pouring and is acceptable for "clean" use by a child or others with limited dexterity. Obviously, consumers further prefer that product costs be as low as possible, and that certain other beneficial attributes associated with the existing box with inner liner packaging continue to be implemented. These existing properties include package strength, product damage protection, use of high volume commercially available materials, visual display of product and promotional material, recycleability, stackability, and moisture, aroma, contaminant and insect protection.

Certain other packaging schemes are available that address, at least in part, several of the above-listed consumer preferences. Unfortunately, however, these packaging techniques entail other drawbacks, thereby limiting their usefulness. For example, rigid plastic containers having removable, sealable lids are available. The greatly increased costs associated with this packaging configuration prohibit its implementation on a mass production basis. Similarly, it may be possible to provide the inner bag with a "zip-lock" sealing feature. While this technique may alleviate several of the reclosure issues previously described, the zip-lock design is expensive and often times does not provide a complete seal. Finally, other packaging techniques, such as elimination of the paper box, do not provide a package having requisite strength. As a point of reference, individual packages are typically shipped in palletized corrugated shipping containers stacked four high with packages. As many a five pallets may be stacked on top of one another. Further, handling of an individual pallet may require a side-to-side force being applied to individual packages. Thus, for any new packaging approach to be viable, sufficient package strength must be provided to limit product damage during shipment.

Consumers continue to express a high demand for particulate-type products sold in a paper cartons. However, various problems associated with use of standard packaging, and in particular box with an inner liner packages, may diminish purchasing enthusiasm. Alternative packaging efforts may satisfy some consumer concerns, but fail to meet other expectations on a cost effective basis. Therefore, a need exists for a particulate-type product canister configured to address consumer preferences while providing sufficient structural strength.

SUMMARY OF THE INVENTION

One aspect of the present invention provides a canister for a particulate-type product. The canister includes opposing face panels, opposing side panels, a top closure and a bottom closure. The opposing side panels are connected to the opposing face panels to define an upper opening and a lower opening. Further, at least one of the opposing face panels or the opposing side panels includes a first paper-based layer, a second paper-based layer and an adhesive. The first and second layers each have an inner surface and an outer surface. The adhesive bonds the inner surface of the first layer to the outer surface of the second layer. The top closure connects the opposing face panels and the opposing side panels so as to encompass the upper opening. The bottom closure connects the opposing face panels and the opposing side panels so as to encompass the lower opening. With the above configuration in mind, the opposing face panels and the opposing side panels combine to define an internal storage region for containing a particulate-type product. In one preferred embodiment, the canister is configured to maintain a food product such as a ready-to-cat cereal. During use, the bonded first and second paper-based layers combine to provide structural integrity for the canister, at a relatively low cost.

Another aspect of the present invention relates to a packaged good article comprising a canister and a particulate-type product. The canister includes opposing face panels, opposing side panels, a top closure and a bottom closure. The opposing side panels are connected to the opposing face panels to define an upper opening and lower opening. At least one of the opposing face panels or the opposing side panels includes a first paper-based layer, a second paper-based layer and an adhesive. The first and second layers each include an inner surface and an outer surface. The adhesive bonds the inner surface of the first layer to the outer surface of the second layer. The top closure connects the opposing face panels and the opposing side panels so as to encompass the upper opening. The bottom closure connects the opposing face panels and the opposing side panels so as to encompass the lower opening. The opposing face panels and the opposing side panels combine to define an internal storage region. The particulate-type product is disposed within the internal storage region. In one preferred embodiment, the particulate-type product is a dry, ready-to-eat cereal.

Yet another aspect of the present invention relates to a method of manufacturing a canister for containing a particulate-type product. The method includes providing a first paper-based layer having an inner surface and an outer surface. A second paper-based layer having an inner surface and an outer surface is also provided. The inner surface of the first layer is bonded to the outer surface of the second layer. The so-bonded first and second layers are formed into a tubular body having an upper opening and a lower opening. The upper opening of the tubular body is encompassed with a top closure. Similarly, the lower opening of the tubular body is encompassed with a bottom closure. The resulting canister forms an internal storage region for containing a particulate-type product. In one preferred embodiment, the resulting canister is configured to maintain a dry, ready-to-eat cereal food product.

DETAILED DESCRIPTION OF THE PREFERRED EMBODIMENTS

Figure 1:
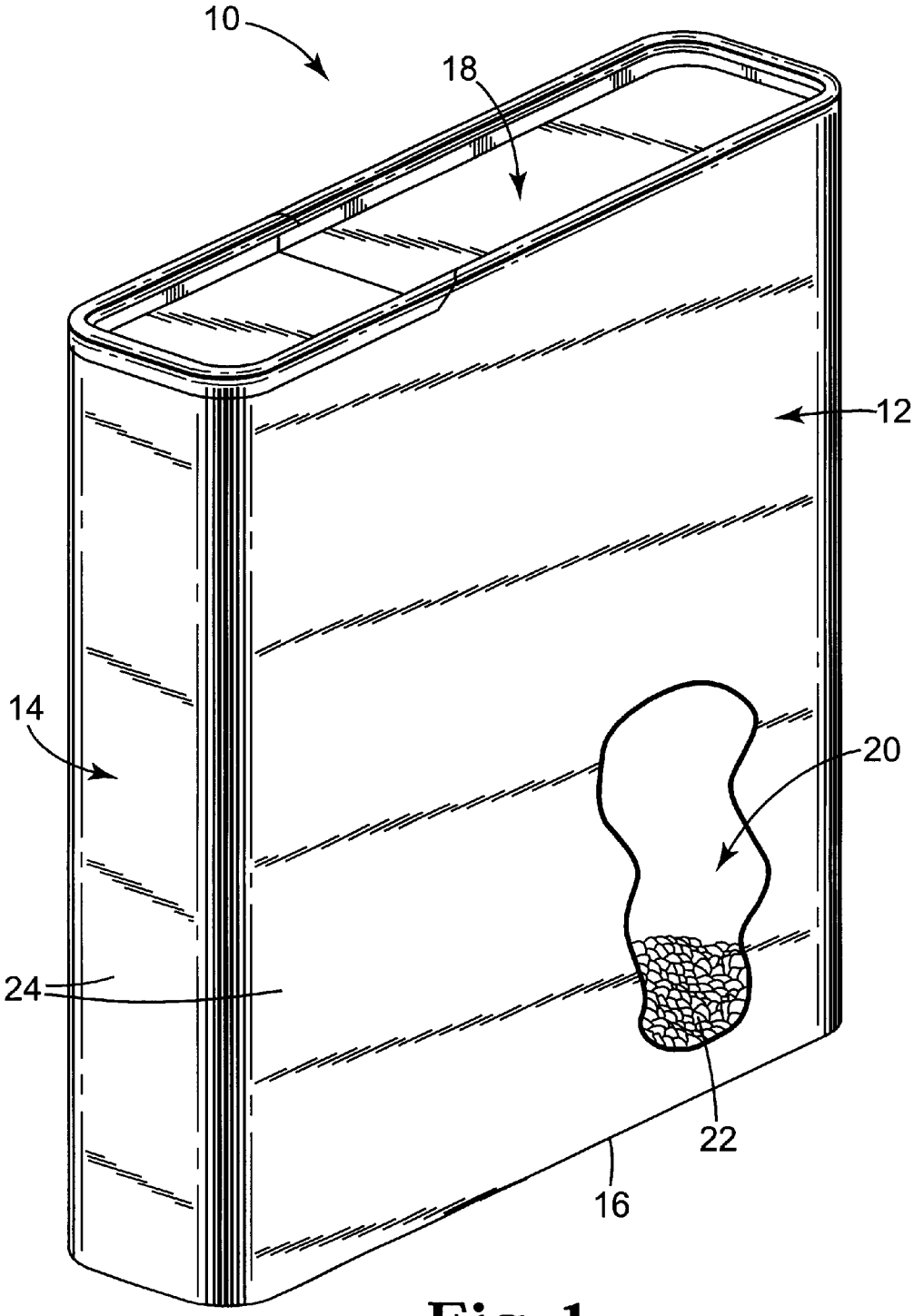
FIG. 1 is a perspective view of a canister in accordance with the present invention, with a portion cut away.

One preferred embodiment of a canister 10 is shown in FIG. 1. The canister 10 includes opposing face panels 12 (one of which is shown in FIG. 1), opposing side panels 14 (one of which is shown in FIG. 1), a bottom panel or closure 16 (shown partially in FIG. 1) and a top panel or closure 18. As described in greater detail below, the opposing face panels 12 and the opposing side panels 14 are connected to one another. The bottom panel 16 is connected to the opposing face panels 12 and the opposing side panels 14 at a lower portion thereof. Similarly, the top panel 18 is connected to the opposing face panels 12 and the opposing side panels 14 at an upper portion thereof. This configuration provides for an internal storage region 20 (shown partially in FIG. 1), within which a particulate-type product 22 is disposed, and an outer surface 24 onto which product or promotional information can be displayed. Notably, directional terminology such as "bottom," "top," "upper" and "lower" is used for purposes of illustration and with reference to a desired upright orientation of the canister 10 as shown in FIG. 1. However, the canister 10 can be positioned in other orientations such that the directional terminology is in no way limiting.

Figure 2:
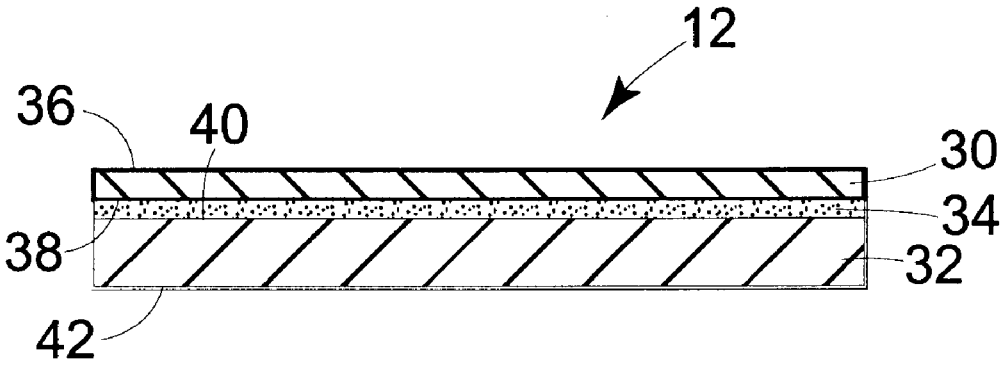
FIG. 2 is a cross-sectional view of a portion of the canister of FIG. 1.

In one preferred embodiment, each of the opposing face panels 12 and the opposing side panels 14 is comprised of at least two paper-based layers. A preferred construction of one of the opposing face panels 12 is shown in FIG. 2, it being understood that an other of the opposing panels 12, as well as the opposing side panels 14 (FIG. 1), are preferably similarly constructed. The panel 12 includes a first layer 30, a second layer 32 and an adhesive 34. The first panel 30 defines an outer surface 36 and an inner surface 38. In one preferred embodiment, and as a point of reference, the outer surface 36 of the first layer 30 corresponds with the outer surface 24 of the canister 10 shown in FIG. 1. The second layer 32 similarly defines an outer surface 40 and an inner surface 42. In one preferred embodiment, and as a point of reference, the inner surface 42 corresponds with an innermost surface of the canister 10 (i.e., defining the internal storage region 20 in FIG. 1). Returning to FIG. 2, the adhesive 34 bonds the inner surface 38 of the first layer to the outer surface 40 of the second layer 32.

The first layer 30 is a paper-based material. In one preferred embodiment, the first layer 30 is label stock paper material being 12 point or less in thickness. Label stock material is readily available and is highly amenable to printing on the outer surface 36. Printing onto label stock paper material is well known in the art and may include product information, promotional statements, etc. To minimize overall costs, the label stock paper is preferably formed from recycled paper. Alternatively, the first layer 30 can have other thicknesses and can be paperboard.

The second layer 32 is similarly a paper-based material. In one preferred embodiment, the second layer 32 is paperboard, having a thickness greater than 12 point. More preferably, the second layer 32 is a 42-pound linerboard. This type of material is readily available, typically akin to virgin paper. Alternatively, the second layer 32 can have other thicknesses and weights, and can be recycled label stock.

By preferably providing two different thicknesses for the first layer 30 and the second layer 32, overall costs of the resulting panel 12 are minimized. In other words, use of a single, thick layer of non-recycled paper inherently increases costs. It should be noted, however, that the first layer 30 and the second layer 32 can alternatively be identical in thickness and composition.

The adhesive 34 is preferably a cold adhesive. For example, the adhesive 34 can be polyvinyl-alcohol, polyvinyl-acetate, casine, starch, etc. Even further, the cold adhesive can be various blends or combinations of acceptable cold adhesive material and/or other materials such as activators. Alternatively, the adhesive 34 can be a hot-melt adhesive, such as a polyethylene-based material with tackafiers and wax, a polypropylene-based material with tackifiers and wax, a polyester-based material with tackifiers and wax, etc. Even further, the hot-melt adhesive can be various co-polymers, blends or a combination of acceptable materials and/or other materials such as activators. Notably, cold adhesives are generally less expensive than hot-melt adhesives and typically require a reduced volume to achieve an appropriate bond. Further, cold adhesives generally do not produce an adverse "adhesive-like" odor that might otherwise adversely affect quality of the product 22 (FIG. 1) contained within the canister 10 (FIG. 1).

Figure 3:
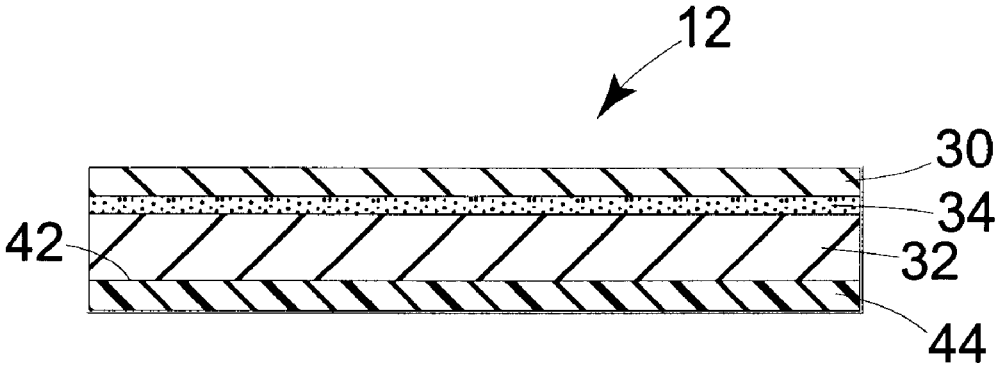
FIG. 3 is a cross-sectional view of a portion of an alternative canister in accordance with the present invention.

While the panel 12 has been described as preferably including two layers, additional layers can be incorporated. For example, as shown in FIG. 3, the panel 12 can include a third layer 44 affixed to the inner surface 42 of the second layer 32. The third layer 44 can be paper-based and can include additional materials such as a plastic.

Figure 4:
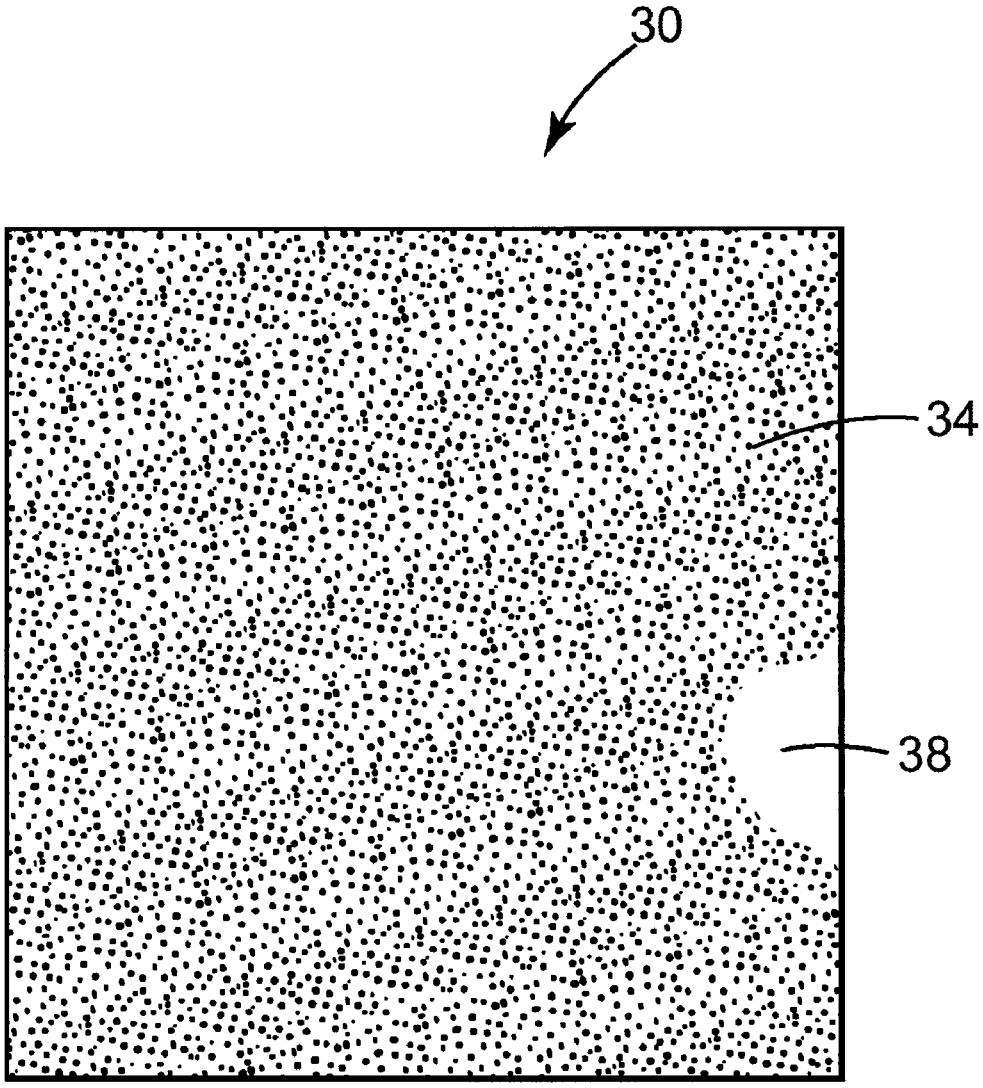
FIG. 4 is a bottom view of a paper-based layer coated with an adhesive forming part of a canister in accordance with the present invention.

Construction of the panel 12 begins with the application of the adhesive 34 to either the inner surface 38 of the first layer 30 or the outer surface 40 of the second layer 32. As shown in FIG. 4, for example, the inner surface 38 of the first layer 30 is coated with the adhesive 34. The first layer 30 can be pre-cut to a desired size. Alternatively, the first layer 30 can be provided as a continuous sheet that, following affixing of the second layer 32 (FIG. 2), is subsequently cut to a desired size. Regardless, in one preferred embodiment, the inner surface 38 of the first layer 30 is entirely coated with the adhesive 34. For example, a continuous roller can be used to apply the adhesive 34 across an entire available area of the inner surface 38. Alternatively, the adhesive 34 can be sprayed onto the inner surface 38. Even further, the first layer 30 may be constructed to include the adhesive 34 and a liner (not shown) protecting the adhesive 34. The liner is removed to expose the adhesive 34. Other adhesive application techniques known in the art can also be employed.

Figure 5:
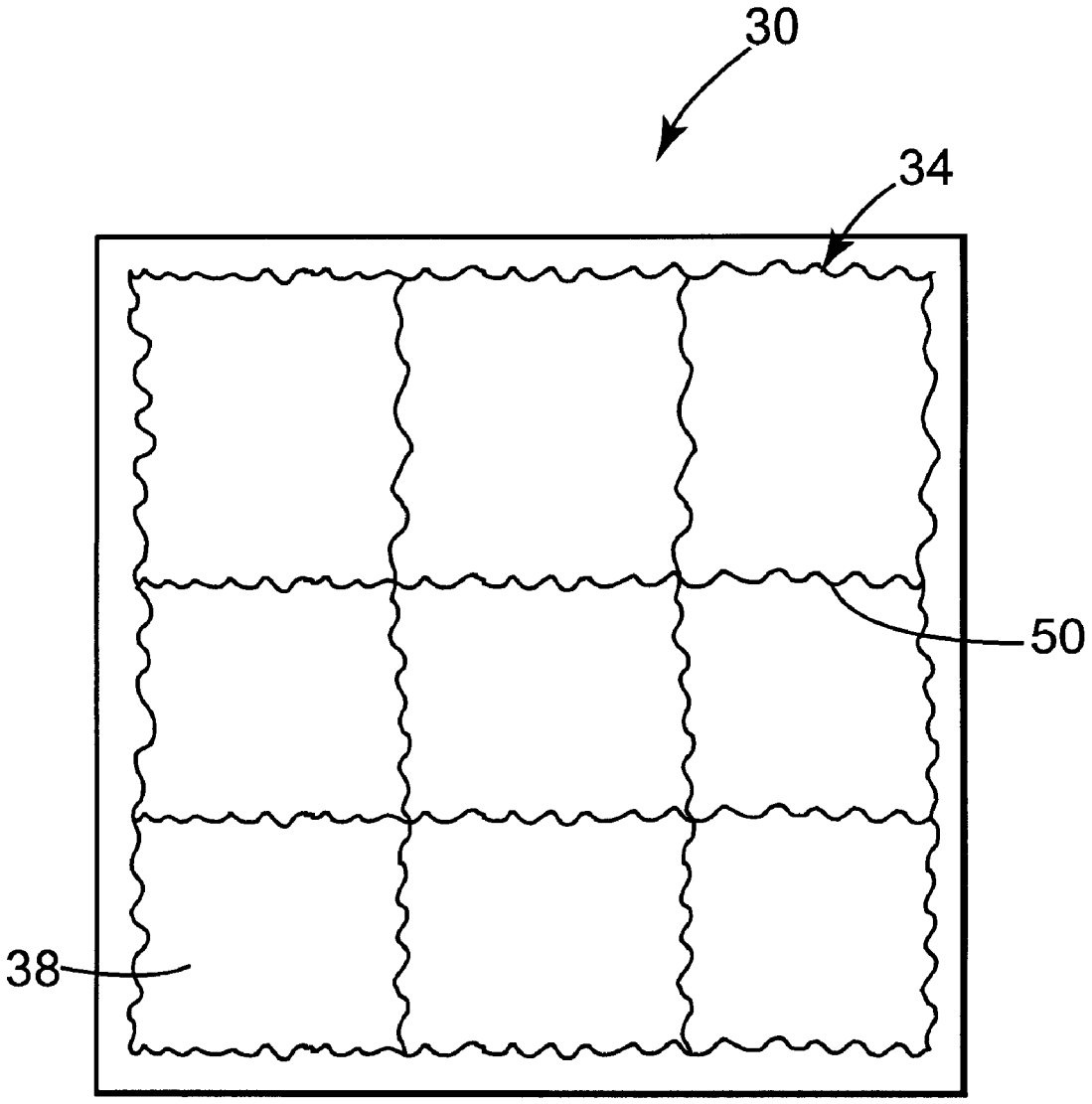
FIG. 5 is a bottom view of a paper-based layer coated with an adhesive forming part of an alternative canister in accordance with the present invention.

By entirely coating the inner surface 38 with the adhesive 34, a complete, thorough bond with the second layer 32 (FIG. 2) is assured. Alternatively, however, it may be desirable to only partially coat or pattern coat the inner surface 38 with the adhesive 34. An example of one pattern-type application of the adhesive 34 is shown in FIG. 5 as an adhesive pattern 50. The adhesive pattern 50 is depicted as assuming a grid-like configuration. Alternatively, other patterns can be utilized. The pattern application can be achieved via a wide variety of known techniques. For example, a release coating or liner can be first printed onto the inner surface 38. A subsequent, flood coating of the adhesive 34 onto the inner surface 38 will not adhere to the printed release coating or the printed release coating can be removed from the inner surface 38, resulting in the desired pattern. Alternatively, where a roller is used to apply the adhesive 34, the roller may be engraved to apply a desired pattern. Even further, the inner surface 38 can be flood coated with the adhesive 34, and then portions of the adhesive 34 removed or otherwise scraped off of the inner surface 38 to generate the adhesive pattern 50. Other adhesive pattern application techniques known in the art can also be employed.

A pattern or partially applied adhesive provides for a number of advantages. For example, because the overall amount of adhesive employed is reduced, costs are minimized. Additionally, any odor-related issues inherent to the selected adhesive are similarly minimized. Along these same lines, because many applicable adhesives are water-based, a reduction in the amount of adhesive applied results in a similar reduction in moisture and therefore opportunity for moisture related distortion of the paper-based layers 30, 32 (FIG. 2). Finally, use of a pattern adhesive enhances recycleability of the resulting panel 12. That is to say, because the relevant surfaces of the first and second layers 30, 32 (FIG. 2) are less than fully covered with the adhesive 34, subsequent separation and related adhesive removal occurs more easily. In one preferred embodiment, to achieve improved recycleability, the adhesive 34 covers less than 90 percent of the available surface area.

Figure 6A:
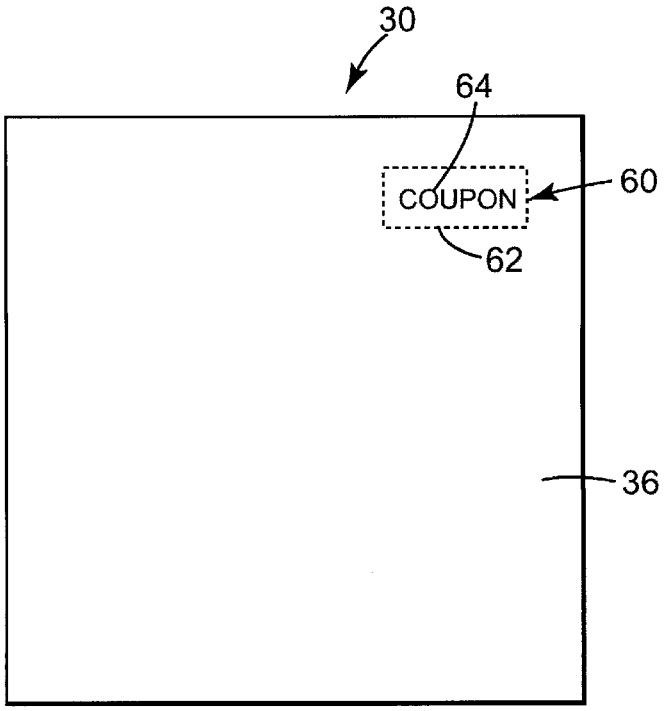
FIG. 6A is a top view of a paper-based layer including a premium forming part of an alternative canister in accordance with the present invention.
Figure 6B:
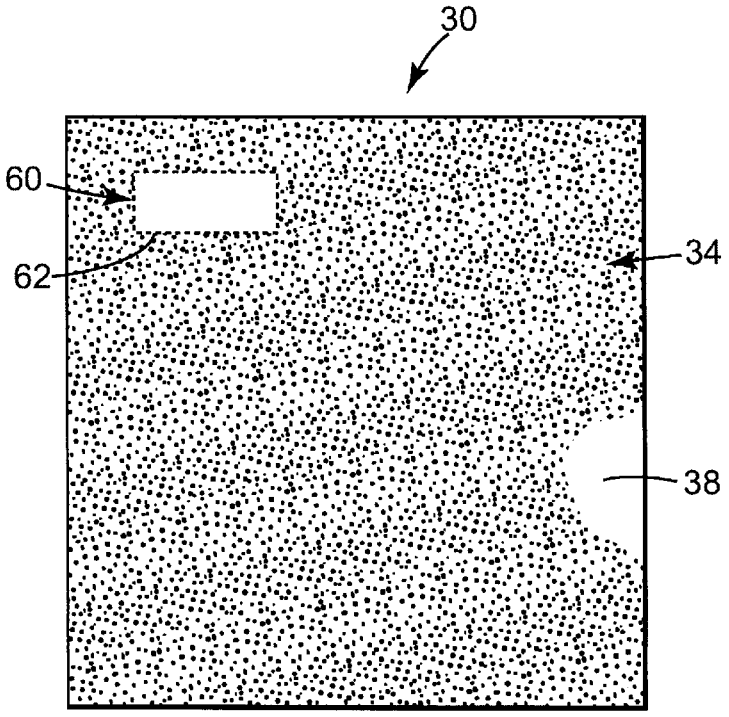
FIG. 6B is a bottom view of the layer of FIG. 6A partially coated with an adhesive.

In addition to enhancing recycleability and minimizing manufacturing costs, a pattern-applied adhesive can be employed to facilitate removal of a portion of the panel 12 by a consumer. For example, as shown in FIG. 6A, the outer surface 36 of the first layer 30 can be formed to include a premium 60. The premium 60 is defined by a perforation 62 and can be a coupon, promotional item, etc., preferably including indicia 64. As shown in FIG. 6B, the adhesive 34 is applied to the inner surface 38 of the first layer 30 such that the adhesive 34 does not encompass the premium 60. As a point of reference, the first layer 30 has been turned over in FIG. 6B (relative to 6A) so as to show the inner surface 38. Thus, the premium 60 is properly depicted at a right portion of the first layer 30 in FIG. 6A, and at a left portion in FIG. 6B. Due to an absence of the adhesive 34, the premium 60 of the first layer 30 will not adhere to the second layer 32 (FIG. 2). By eliminating the adhesive 34 from that area of the first layer 30 opposite the premium 60, a user (not shown) can easily remove the premium 60 from the first layer 30 via the perforations 62.

While the adhesive 34 has been described as preferably being applied to the inner surface 38 of the first layer 30, the adhesive 34 can instead, or in addition, be applied to the outer surface 40 (FIG. 2) of the second layer 32. That is to say, each of the above-described coating techniques (either full or partial coverage) apply equally as well to coating of the outer surface 40 of the second layer 32.

Figure 7:
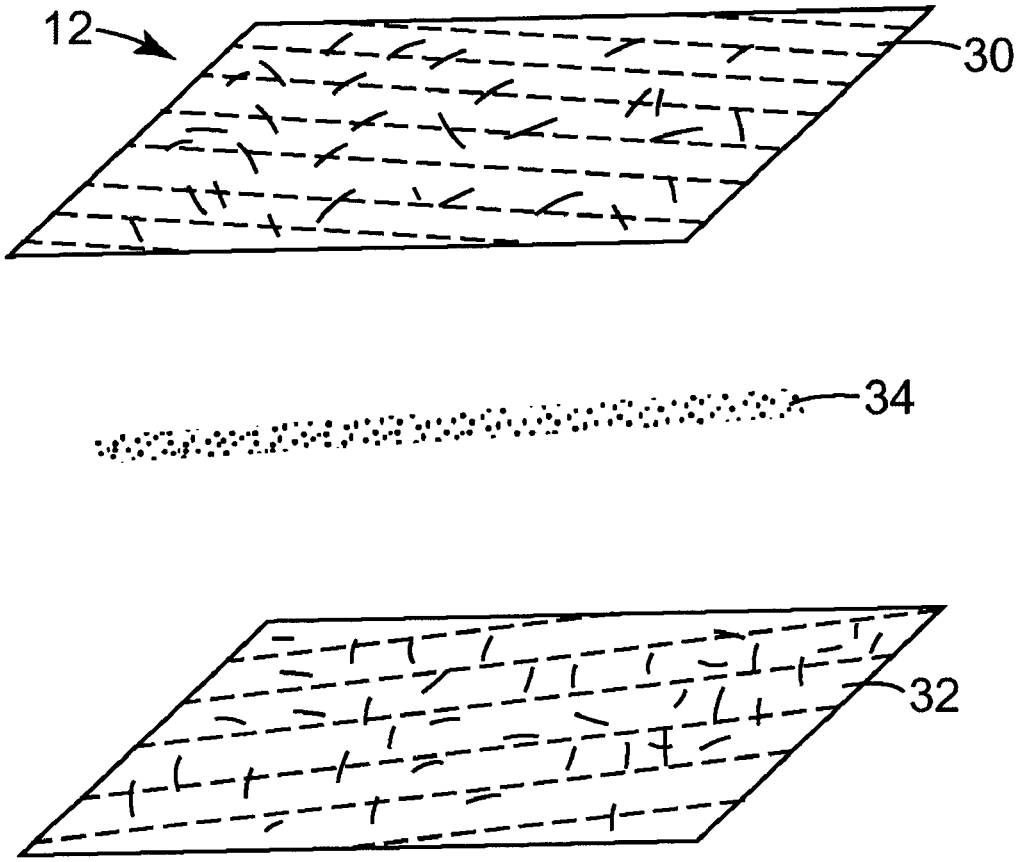
FIG. 7 is an exploded view of a panel forming part of a canister in accordance with the present invention.

Following application of the adhesive 34 to the inner surface 38 of the first layer 30 and/or the outer surface 40 of the second layer 32, the first layer 30 and the second layer 32 are bonded to one another as shown in FIG. 7. In one preferred embodiment, each of the first layer 30 and the second layer 32 can be manufactured to define generally a paper fiber direction. As is known in the art, during manufacture of paper (label stock or paperboard), related processing imparts a longitudinal pulling force or stretch in a "machine direction" to align the fibers generally in one direction. Notably, however, not all fibers will follow the machine direction, and will instead be randomly orientated and/or intertwined. Because the first and second layers 30, 32 are preferably formed from different types of paper (and therefore are not identical), the random fibers from the respective layers will not align with one another upon final assembly. The resulting combination will have a strength (or ring crush strength) greater than a ring crush strength of a single layer of paper having a thickness equal to the first and second layers 30, 32.

Figure 8:
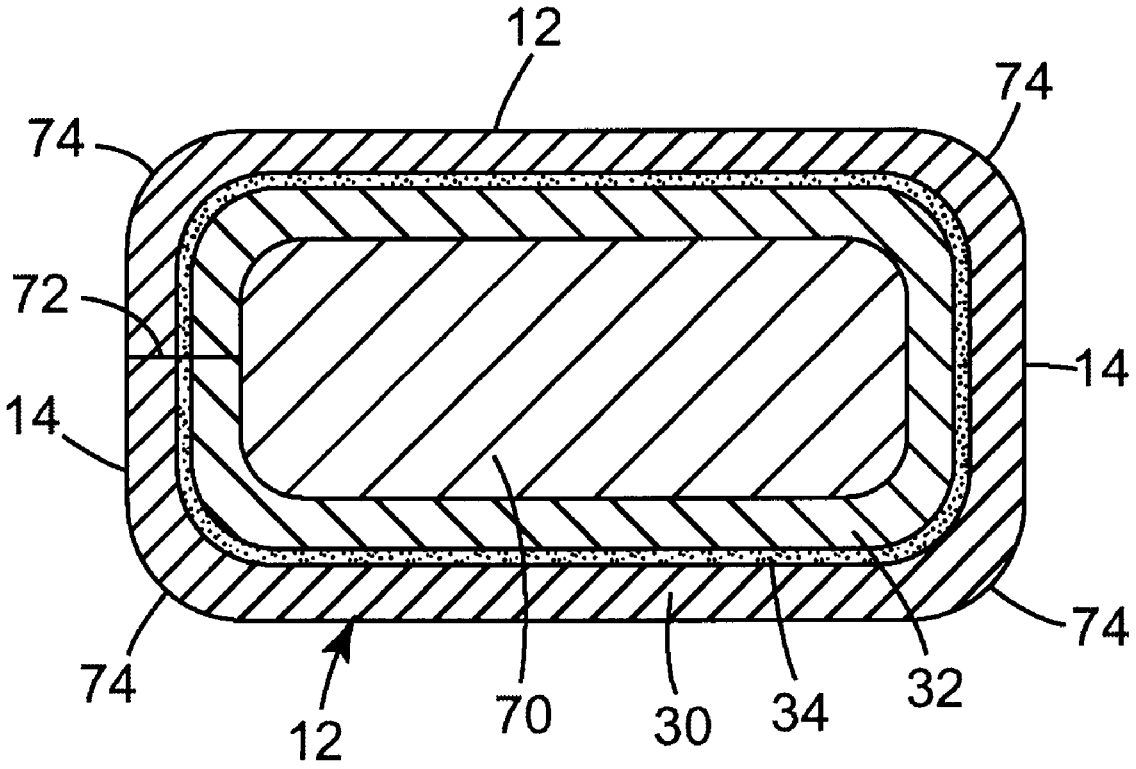
FIG. 8 is a side, cross-sectional view depicting assembly of a portion of a canister in accordance with the present invention.

Following attachment of the first layer 30 to the second layer 32, the opposing face panels 12 and the opposing side panels 14 are formed, for example as depicted in FIG. 8. In one preferred embodiment, the first layer 30 and the second layer 32 are elongated and wrapped about a mandrel 70. Opposing edges of the first layer 30 and the second layer 32 are connected to form a seal 72. The seal 72 can be a butt seal as shown, but alternatively can be an overlap seal, fin seal, etc. As shown in FIG. 8, in this sealed configuration, the first layer 30 and the second layer 32 combine to define and integrally form the opposing face panels 12 and the opposing side panels 14. Notably, with this mandrel fabrication technique, corners 74 formed by the opposing face panels 12 and opposing side panels 14 are preferably rounded or arcuate, but can instead be angular. Alternatively, the opposing face panels 12 and the opposing side panels 14 can be independently formed and subsequently connected, preferably sealed, to one another. As few as one of the opposing face panels 12 or the opposing side panels 14 need include the first layer 30 and the second layer 32 bonded by the adhesive 34, although in the preferred embodiment, all of the panels 12, 14 are so-constructed.

Figure 9:
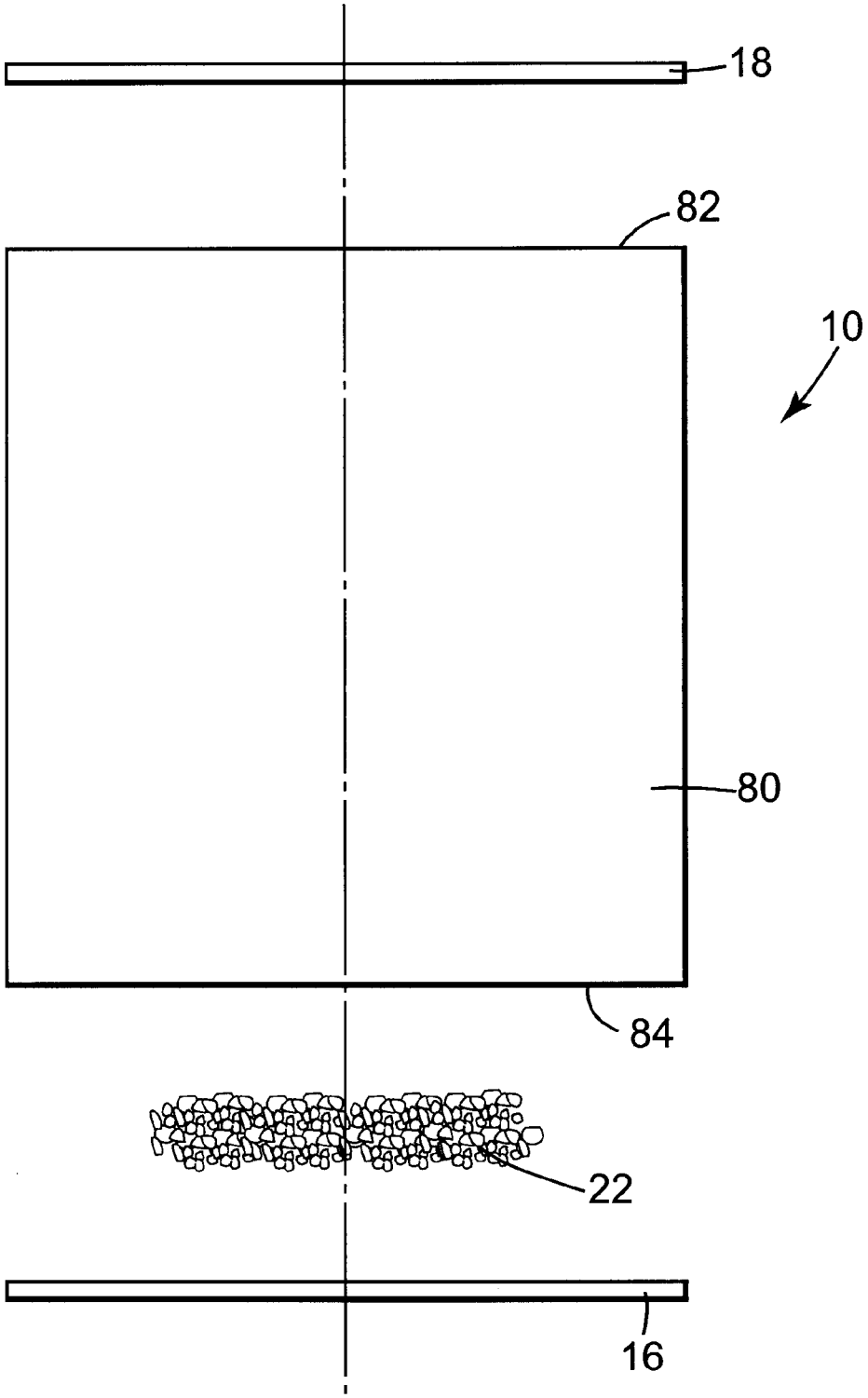
FIG. 9 is an exploded view of a canister in accordance with the present invention.

Regardless of the exact manufacturing technique, the remainder of the canister 10 is then constructed as shown in FIG. 9. In one preferred embodiment, the opposing face panels 12 and the opposing side panels 14 combine to define a tubular body 80 having an upper opening 82 (shown partially in FIG. 9) and a lower opening 84 (shown partially in FIG. 9). The top panel or closure 18 is then connected to the tubular body 80 so as to encompass the upper opening 82. Alternatively, the upper opening 82 can simply be sealed closed. The particulate-type product 22 is then placed within the internal storage region 20 (FIG. 1) defined by the tubular body 80. Finally, the bottom panel or closure 16 is connected to the tubular body 80 so as to encompass the lower opening 84. Alternatively, the lower opening 84 can simply be sealed closed. While construction of the canister 10 has been described as preferable including placement of the top panel 18 and then the bottom panel 16, this order can be reversed.

Figure 10:
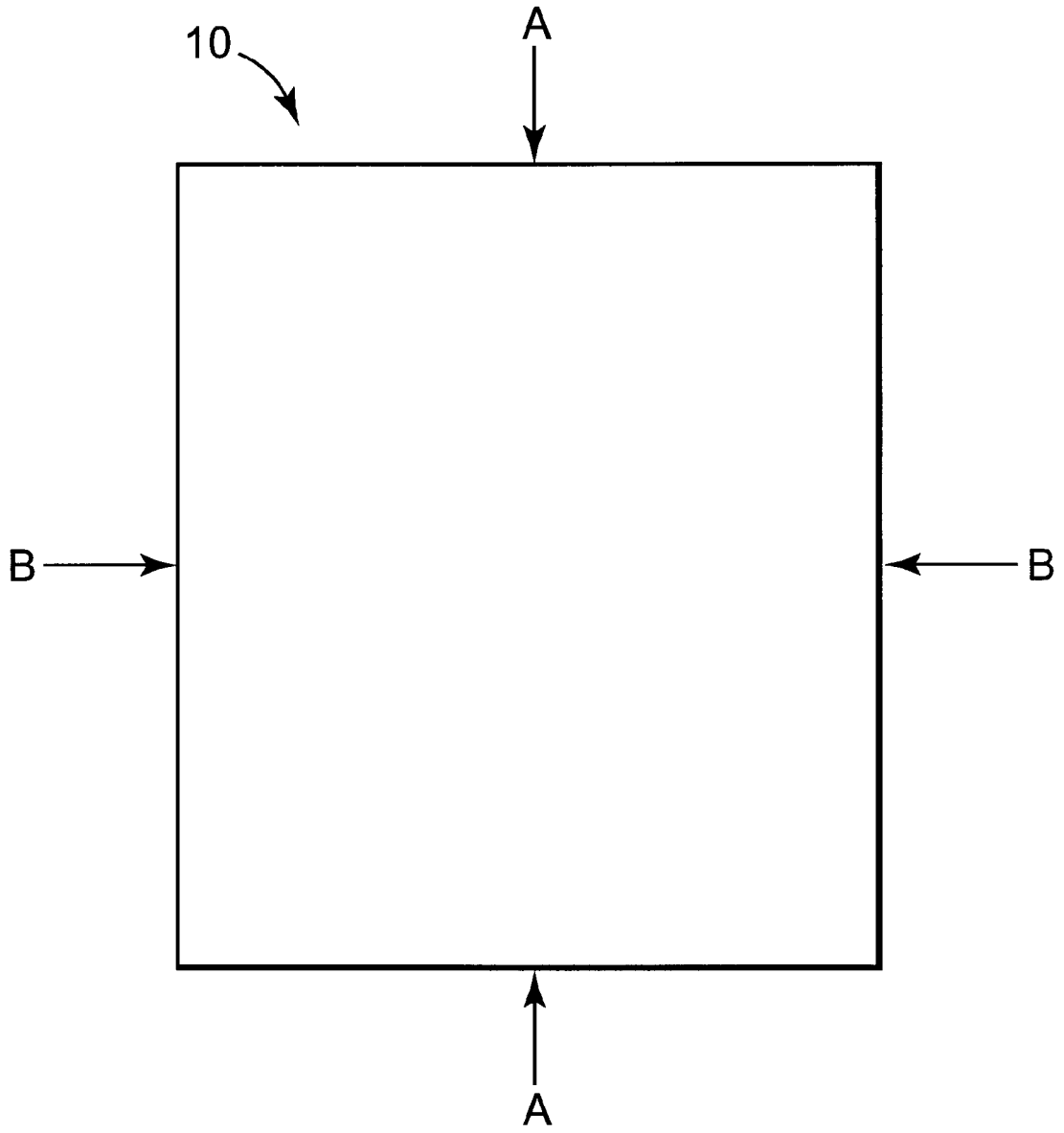
FIG. 10 is a side view of a canister in accordance with the present invention.

Upon final assembly, the canister 10 is relatively rigid, able to withstand both longitudinal and transverse forces as shown in FIG. 10. That is to say, by forming at least one of the opposing face panels 12 or the opposing side panels 14 with at least two paper-based layers bonded by an adhesive, the resulting canister 10 has sufficient strength to withstand forces normally encountered during shipping and handling. For example, as previously described, the canister 10 will normally be shipped in pallet or cube form. That is to say, individual canisters are packed into a corrugated shipping container or cube that is secured to a pallet. Within each individual cube, it is possible that three additional canisters will be stacked on top of the canister 10 (relative to the upright orientation shown in FIG. 10). Additionally, as many as five so-configured pallets will be stacked on top of one another. As a result, it is possible that the canister 10 will experience a longitudinal force (designated by the arrows A in FIG. 10) in the range of approximately 50–2000 pounds. Similarly, in some instances, individual pallets may be handled by a clamp-type fork truck. This device engages and retains individual pallets by imparting a side or transverse force across the cube. Thus, the canister 10 may experience a side-to-side force (designated by the arrows B in FIG. 10) in the range of approximately 50–2000 pounds. With the above shipping-related constraints in mind, the canister 10 of the present invention is configured to maintain its integrity when placed under a longitudinal compressive force of approximately 50–2000 pounds and a transverse or side-to-side compressive force of approximately 50–2000 pounds. In fact, the canister 10 in accordance with the preferred embodiment has a shown a longitudinal strength of at least two times the longitudinal strength associated with currently available box with an inner liner packages. Further, the canister 10 can be formed to include rounded corners 74 (FIG. 8), yet still provide sufficient side-to-side strength.

By providing the canister 10 with requisite packaging strength, the canister 10 can be used to maintain a wide variety of particulate-type products. For example, the particulate-type product 22 (FIG. 1) can be a food product, and in particular a dry food product. One specific category of available food products is cereal-based products (e.g., formed from wheat, oats, rice, etc). These include ready-to-eat cereals such as puffs, flakes, shreds and combinations thereof. Further, the ready-to-eat cereal product can include other ingredients such as dried fruits, nuts, dried marshmallows, sugar coatings, etc. Alternatively, other particulate-type dried food products can be contained within the canister 10 such as, for example, popcorn (popped or unpopped), dried pasta (e.g., spaghetti noodles), rice, beans, pretzels, potato chips, sugar, dried milk, flour, etc. Even further, other consumable items such as birdseed can be used as the particulate-type product 22. Yet even further, non-consumable particulate-type products can be stored including fertilizer pellets, dry laundry detergent, dry dishwashing detergent, plant or vegetable seeds, de-icing salt pellets, etc.

The canister of the present invention provides a marked improvement over previous designs. Pointedly, the canister provides for enhanced package strength via incorporation of at least two paper-based layers bonded to one another with an adhesive. These components are readily available and can be assembled on a highly cost-effective basis. Further, where the adhesive is preferably partially or pattern applied, further cost savings arc achieved, while at the same time enhancing recycleability, removal of premiums, etc.

Although the present invention has been described with reference to preferred embodiments, workers skilled in the art will recognize that changes may be made in form and detail without departing from the spirit and scope of the present invention. For example, the canister has been depicted as being generally rectangular in shape. Alternatively, other shapes are equally acceptable. Also, the canister can contain items in addition to the particulate-type product described. For example, a separate coupon or premium can be placed within the canister along with the particulate-type product. Further, while the layers comprising at least a portion of the canister have been described as being paper-based, other materials, such as foil or plastic, can instead be used.

What is claimed is:

1. A canister for containing a particulate product, the canister comprising:

opposing face panels;

opposing side panels connected to the opposing face panels to define an upper opening and a lower opening, wherein the opposing face panels and the opposing side panels are formed by:

a first paper-based layer having an inner surface and an outer surface, the inner surface having a perimeter, a second paper-based layer having an inner surface and an outer surface, the outer surface of the second layer having a perimeter, an adhesive bonding less than 90% of the inner surface of the first layer to the outer surface of the second layer, the adhesive bonding an entirety of the respective perimeters;

a top panel formed apart from and connected to the opposing face panels and the opposing side panels so as to encompass the upper opening; and a bottom panel formed apart from and connected to the opposing face panels and the opposing side panels so as to encompass the lower opening;

wherein the panels combine to define an internal storage region for containing a particulate product.

2. The container of claim 1, wherein the first layer is a label stock material.

3. The canister of claim 2, wherein the second layer is a paperboard material.

4. The canister of claim 1, wherein the adhesive is a cold adhesive.

5. The canister of claim 4, wherein the cold adhesive includes a material selected from the group consisting of polyvinyl alcohol, polyvinyl acetate, casine and starch.

6. The canister of claim 1, wherein the adhesive is a hot-melt adhesive.

7. The canister of claim 6, wherein the hot-melt adhesive includes a material selected from the group consisting of polyethylene, polypropylene and polyester.

8. The canister of claim 1, wherein at least one of the opposing face panels or the opposing side panels further includes:

a third plastic-based layer secured to the inner surface of the second layer.

9. The canister of claim 1, wherein the adhesive defines a pattern on the inner surface of the first layer.

10. The canister of claim 9, wherein the pattern is a grid.

11. The canister of claim 1, wherein the outer surface of the first layer defines a premium, and further wherein the adhesive does not cover the inner surface of the first layer opposite the premium.

12. The canister of claim 1, wherein the opposing face panels and the opposing side panels are integrally formed.

13. The canister of claim 1, wherein the canister is configured to contain a ready-to-eat cereal product.

14. The canister of claim 1, wherein an interface area is defined between the inner surface of the first layer and the outer surface of the second layer, the adhesive encompassing less than 90% of the interface area.

15. The canister of claim 14, wherein at least three separated regions of the interface area are free of adhesive.

16. The canister of claim 1, wherein at least three separated regions of the inner surface of the first layer are not bonded to the outer surface of the second layer.

17. A packaged good article comprising:

a canister comprising:

opposing face panels, opposing side panels connected to the opposing face panels to define an upper opening and a lower opening, wherein the opposing face panels and the opposing side panels are formed by:

a first paper-based layer having an inner surface and an outer surface, the inner surface having a perimeter, a second paper-based layer having an inner surface and an outer surface, the outer surface of the second layer having a perimeter, an adhesive bonding less than 90% of the inner surface of the first layer to the outer surface of the second layer, the adhesive bonding an entirety of the respective perimeter, a top panel formed apart from and connected to the opposing face panels and the opposing side panels so as to encompass the upper opening, a bottom panel formed apart from and connected to the opposing face panels and the opposing side panels so as to encompass the lower opening, wherein the opposing panels combine to define an internal storage region; and a particulate product disposed within the internal storage region.

18. The packaged good article of claim 17, wherein the first layer is a label stock material.

19. The packaged good article of claim 18, wherein the second layer is a paperboard material.

20. The packaged good article of claim 17, wherein the adhesive is a cold adhesive.

21. The packaged good article of claim 20, wherein the cold adhesive includes a material selected from the group consisting of polyvinyl alcohol, polyvinyl acetate, casine and starch.

22. The packaged good article of claim 17, wherein the adhesive is a hot-melt adhesive.

23. The packaged good article of claim 22, wherein the hot-melt adhesive includes a material selected from the group consisting of polyethylene, polypropylene and polyester.

24. The packaged good article of claim 17, wherein at least one of the opposing face panels or the opposing side panels further includes:

a third plastic-based layer secured to the inner surface of the second layer.

25. The packaged good article of claim 17, wherein the adhesive defines a pattern on the inner surface of the first layer.

26. The packaged good article of claim 25, wherein the pattern is a grid.

27. The packaged good article of claim 17, wherein the outer surface of the first layer defines a premium, and further wherein the adhesive does not cover the inner surface of the first layer opposite the premium.

28. The packaged good article of claim 17, wherein the opposing face panels and the opposing side panels are integrally formed.

29. The packaged good article of claim 17, wherein the particulate product is a dry food product.

30. The packaged good article of claim 29, wherein the dry food product is a ready-to-eat cereal product.

31. A method of manufacturing a canister for containing a particulate product, the method comprising:

providing a first paper-based layer having an inner surface and an outer surface, the inner surface having a perimeter;

providing a second paper-based layer having an inner surface and outer surface, the outer surface of the second layer having a perimeter;

bonding less than 90% of the inner surface of the first layer to the outer surface of the second layer such that an entirety of the respective perimeters are directly bonded to one another;

forming the bonded first and second layers into a tubular body having an upper opening and a lower opening;

providing a top panel separate from the tubular body;

connecting the top panel to the tubular body so as to encompass the upper opening;

providing a bottom panel separate from the tubular body; and connecting the bottom panel to the tubular body so as to encompass the lower opening;

wherein the tubular body defines an internal storage region for containing a particulate product.

32. The method of claim 31, wherein bonding the first layer to the second layer includes:

applying an adhesive to the inner surface of the first layer; and placing the outer surface of the second layer onto the adhesive.

33. The method of claim 32, wherein coating the inner surface includes:

forming a pattern with the adhesive on the inner surface of the first layer.

34. The method of claim 33, wherein the pattern is a grid.

35. The method of claim 32, wherein the outer surface of the first layer defines a premium, and wherein coating the inner surface of the first layer includes:

preventing application of the adhesive to the inner surface of the first layer opposite the premium.

36. The method of claim 31, wherein each of the first and second layers defines a paper fiber direction, and further wherein bonding the first layer to the second layer includes:

orientating the first layer relative to the second layer such that the paper fiber direction of the first layer is not aligned with the paper fiber direction of the second layer.

37. The method of claim 31, wherein bonding less than 90% of the first layer to the second layer includes:

preventing at least three separated regions of an interface between the first layer and the second layer from being bonded to one another.

38. The method of claim 31, further including:

bonding a third, plastic-based layer to the inner surface of the second layer.

39. The method of claim 31, further including:

disposing a ready-to-eat cereal product within the internal storage region.

40. The packaged good article of claim 17, wherein an interface area is defined between the inner surface of the first layer and the outer surface of the second layer, the adhesive encompassing less than 90% of the interface area.

41. The packaged good article of claim 40, wherein at least three separated regions of the interface area are free of adhesive.

42. The packaged good article of claim 17, wherein at least three separated regions of the inner surface of the first layer are not bonded to the outer surface of the second layer.

* * * * *